US006137341A

United States Patent [19]

Friedman et al.

[11] Patent Number: 6,137,341

[45] Date of Patent: Oct. 24, 2000

[54] TEMPERATURE SENSOR TO RUN FROM POWER SUPPLY, 0.9 TO 12 VOLTS

[75] Inventors: Jay Friedman, Felton; Robert Allen Pease, San Francisco, both of Calif.

[73] Assignee: National Semiconductor Corporation, Santa Clara, Calif.

[21] Appl. No.: 09/148,048

[22] Filed: Sep. 3, 1998

[51] Int. Cl.[7] ..... G05F 5/26

[52] U.S. Cl. ..... 327/513; 327/512; 323/314

[58] Field of Search ..... 327/512, 513, 327/509; 323/313, 314

[56] References Cited

U.S. PATENT DOCUMENTS

| | | | |
|---|---|---|---|
| 4,497,586 | 2/1985 | Nelson | 374/163 |
| 4,657,658 | 4/1987 | Sibbald | 327/513 |
| 5,519,354 | 5/1996 | Audy | 327/512 |

OTHER PUBLICATIONS

Pease, Robert A., "A New Fahrenheit Temperature Sensor", IEEE Journal of Solid–State Circuits, vol. SC–19, No. 6. Dec. 1984, pp. 971–977.

*Primary Examiner*—Dinh T. Le

*Attorney, Agent, or Firm*—Limbach & Limbach L.L.P.

[57] ABSTRACT

A temperature sensor circuit generates an output voltage that is linearly proportional to temperature over a desired temperature range with a desired offset voltage. The temperature sensor includes two Proportional To Absolute Temperature (PTAT) current sources that generate PTAT currents and two transistors which conduct the PTAT currents with different current densities to establish a basic voltage PTAT across a resistor. An offset resistor coupled between the bases of the two transistors and a circuit node, shifts the basic PTAT voltage by an offset voltage. A first gain circuit couples to the collector of the first transistor and the offset resistor and generates a servo current (i.e., a current that tends to move the circuit to the desired state by correcting an error) to servo the base of the first transistor when there is a difference between the first transistor's collector current and the PTAT current. A second gain circuit generates a second servo current to servo the emitter of the second transistor when there is a difference between the second transistor's collector current and the PTAT current. These servo currents drive the two transistors such that the second gain circuit generates a temperature related output voltage shifted from the basic voltage PTAT by the offset voltage, and which follows a predetermined temperature scale and has a substantially linear function with a desired offset temperature.

25 Claims, 3 Drawing Sheets

TEMPERATURE SENSOR TO RUN FROM POWER SUPPLY, 0.9 TO 12 VOLTS

BACKGROUND OF THE INVENTION

1. Field of the Invention

The present invention relates to integrated circuits (ICs), temperature sensors, and in particular, to a temperature sensor for use with low voltage power supply circuits.

2. Description of the Related Art

The base-emitter voltage VBE of a forward-biased transistor is a fairly linear function of absolute temperature T in degrees Kelvin (° K.), and is known to provide a stable and relatively linear temperature sensor. Proportional To Absolute Temperature (PTAT) sensors eliminate the dependence on collector current by using the difference ΔVBE between the base-emitter voltages VBE1 and VBE2 of two transistors that are operated at a constant ratio between their emitter-current densities to form the PTAT voltage. The emitter-current density is conventionally defined as the ratio of the collector current to the emitter size. Thus, the basic PTAT voltage ΔVBE is given by:

$$\Delta VBE = VBE1 - VBE2 \quad (1)$$

$$\Delta VBE = (kT/q) * \ln(J1/J2) \quad (2)$$

where k is Boltzmann's constant, T is the absolute temperature in degreed (Kelvin), q is the electron charge and J1 is the current density of a transistor T1 and J2 is the current density of a transistor T2. As a result, when two silicon junctions are operated at different current densities (J1, J2), the differential voltage ΔVBE is a predictable, accurate and linear function of temperature.

The basic PTAT voltage is amplified so that its gain, i.e., its sensitivity to changes in absolute temperature, can be calibrated to a desired value, suitably 10 mV/° K., and buffered so that a PTAT voltage can be read out without corrupting the basic PTAT voltage. A temperature sensor embodying such technology is the LM135 Precision Temperature Sensor, available from National Semiconductor Corporation. Such temperature sensors when biased from a nominal source of current develop a 10 mV/° K. voltage response, operate over the range of −55° C. to 155° C., and when calibrated at 25° C. have less than a 1° C. error over a 100° C. range. To obtain a Fahrenheit or Celsius scale reading the output of a sensor is combined with the output of a precision temperature-stable voltage that is designed to be equal to the temperature sensor at the temperature scale's zero point. This is an undesirable approach because it requires a sensor along with a number of other stable, low-drift external components.

It is well-recognized that a single IC chip could be provided with the circuits necessary to develop both a temperature-related voltage and a temperature-stable precision reference voltage. However, this would require a very complex IC design.

FIG. 1 illustrates a conventional temperature sensor 100 that provides an output voltage Vout scaled Proportional To Fahrenheit Temperature (PTFT). Thus, output voltage Vout of PTFT sensor 100 rises in proportion to changes in Fahrenheit temperature. As shown in FIG. 1, conventional n-p-n transistors QA, QB have a 10:1 emitter area ratio and generate a large PTAT voltage VPTAT of about 1.59 V at room temperature. This characteristic is shown as curve 41 of the graph in FIG. 4. The base-emitter voltages of conducting transistors have a negative temperature coefficient, shown as curve 42 of FIG. 4. Therefore, the two base-emitter voltages VBEs of transistors QB, QC are subtracted from the large PTAT voltage VPTAT to shift the voltage VPTAT by an offset voltage. The resulting voltage is amplified by non-inverting amplifier A2 to provide an output voltage Vout that is linearly proportional to Fahrenheit temperature. This characteristic curve is shown as curve 43 of FIG. 4.

With the 10:1 emitter ratio shown, at 77° F. the two transistors QA, QB require a 60 mV (VPTAT) offset to be imposed across R1. To enforce this condition, amplifier A1 will servo the base of transistor QA to a level of n * 60 mV, also voltage VPTAT. A value of 26.5 is chosen for n so that at 77° F. the voltage across resistor R1 is 1590 mV with a slope of 2.963 mV/° F. Then from this voltage the two base-emitter voltages VBEs of transistors QA, QB are subtracted. Their 77° F. value of (588.2 mV−1.2032 mV/° F.) each provides a 77° F. result of 413.5 mV plus 5.37 mV/° F. at the positive input of non-inverting amplifier A2. When this voltage is amplified by a gain of 1.862, the output voltage Vout at 77° F. will be 770 mV with a gain of e.g., 10 mV/° F. If there is an error in the output voltage Vout at any particular temperature, this error can be fixed by adjusting the ratio n. In this manner, the offset voltage is effectively subtracted so that the output voltage Vout of PTFT sensor 100 is 0 V at 0° F. and is linearly proportional to Fahrenheit temperature, having a slope of 10 mV/° F.

The conventional PTFT sensor 100 of FIG. 1 has several drawbacks. Such sensor 100 requires relatively large supply voltages to respond over the desired operating range and to supply any overhead voltage needed to operate the sensor. Over the past decade, there has been a trend toward reducing the supply voltage which has gradually decreased from 5 Volts to 2.5 and is now even as low as approximately 1 Volt. Thus, products which run off lower voltage supplies cannot use PTFT sensors of the type shown in FIG. 1. Even low-voltage sensors having a regulator configuration are unacceptable due to the Early Effect, a change in collector current with a change in collector voltage.

Another drawback is that nonlinearities occur on the order of 1 to 3 percent over a 360 degree Fahrenheit range. Although additional circuits can be added to temperature sensor 100 to cancel these nonlinearities, such circuits require additional voltage.

Thus, a need exists for a temperature sensor that operates on a wide range of supply voltage, from approximately one to twelve volts. In addition, such temperature sensor should operate without the occurrence of uncorrected nonlinearities.

SUMMARY OF THE INVENTION

A temperature sensor in accordance with one embodiment of the present invention is capable of operating on a wide range of supply voltage, from approximately one to twelve volts. Such temperature sensor includes two Proportional To Absolute Temperature (PTAT) current sources that generate PTAT currents. Two transistors couple to the PTAT current sources and conduct currents with different current densities to establish a basic voltage PTAT across a first resistor. An offset resistor couples between the bases of the two transistors and a circuit node to shift the basic PTAT voltage by an offset voltage.

One gain circuit couples between the first transistor and the circuit node and generates a first servo current which is proportional to the voltage across the first resistor when there is a difference between the PTAT current and the current through the first transistor. Another gain circuit couples to the second transistor and generates a second servo current when there is a difference between the current through the second transistor and the PTAT current.

These two servo currents drive the two transistors such that a temperature related output voltage that follows a predetermined temperature scale has a substantially linear function and extrapolates to zero volts at a desired offset temperature corresponding to the offset voltage.

In an alternate embodiment of the temperature sensor, the first resistor, across which the basic PTAT voltage is established, is trimmable to set the offset voltage. When the temperature sensor also includes a trimmable output resistor that conducts the second servo current to provide the desired temperature related output voltage, the ratio of the first resistor, the offset resistor and the output resistor is selected to set the offset voltage.

A temperature sensor in accordance with another embodiment of the present invention includes a curvature correction circuit for correcting any deviation of a current proportional to base-emitter voltage of the second transistor from a linear response to temperature.

A temperature sensor in accordance with still another embodiment of the present invention includes a gain-limiting circuit coupled across the base and emitter of the first transistor, to limit gain from the loop including the first gain circuit and the first transistor.

These and other features and advantages of the present invention will be understood upon consideration of the following detailed description of the invention and the accompanying drawings.

BRIEF DESCRIPTION OF THE DRAWINGS

Like reference symbols are employed in the drawings and in the description of the preferred embodiment to represent the same or similar items.

DESCRIPTION OF THE PREFERRED EMBODIMENT

Figure 1:
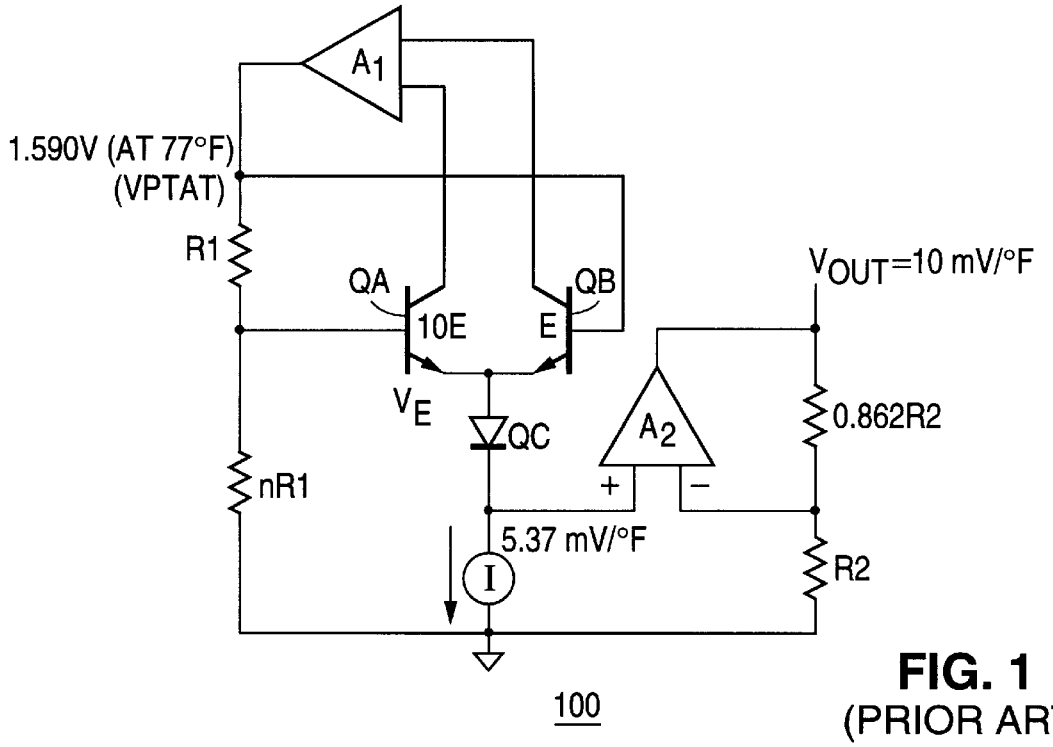
FIG. 1 (PRIOR ART)
FIG. 1 illustrates a schematic diagram of a conventional temperature sensor.
Figure 2:
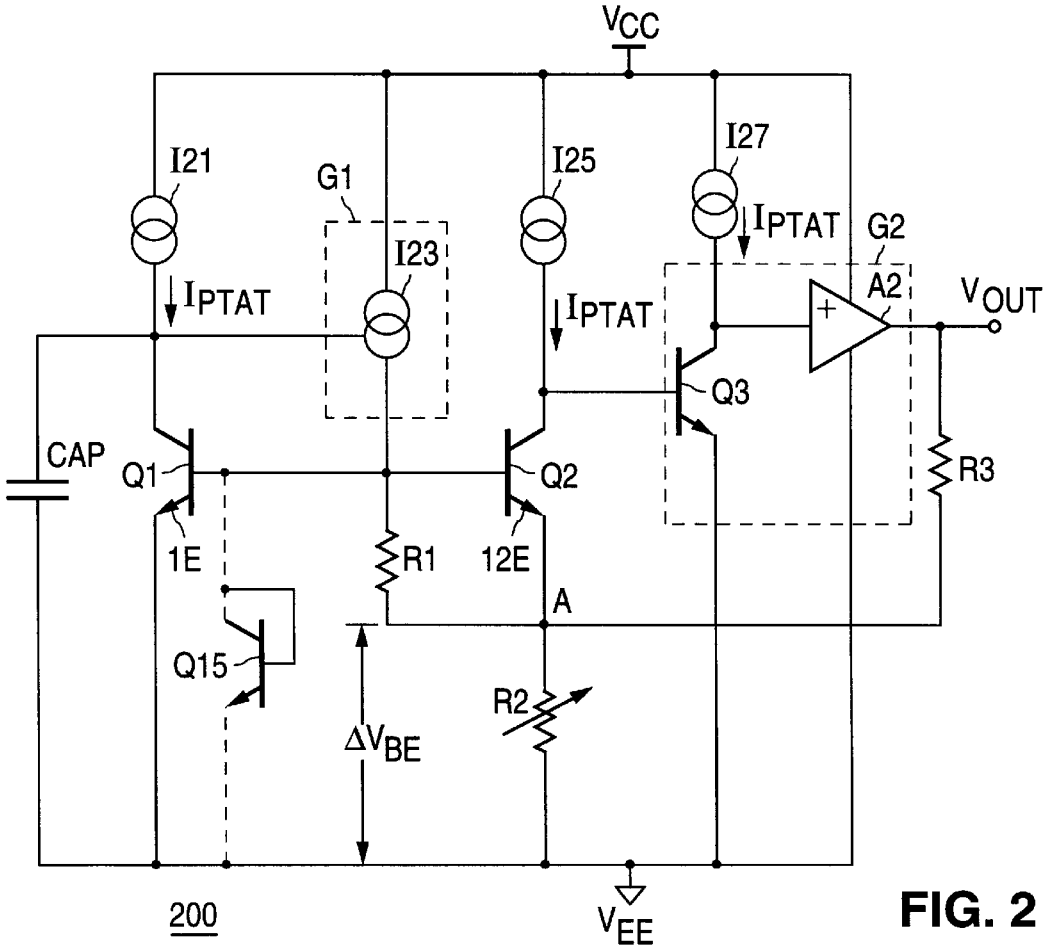
FIG. 2 is a schematic diagram of a temperature sensor in accordance with one embodiment of the present invention.

A schematic diagram of a temperature sensor 200 in accordance with a first embodiment of the present invention is illustrated in FIG. 2. The temperature sensor 200 includes amplifier and servo circuitry to provide a basic PTAT voltage ΔVBE, where the basic PTAT voltage ΔVBE, as described in equations 2 and 3, is ΔVBE=(kT/q)* ln(J2/J1). Temperature sensor 200 operates to provide an output voltage Vout directly related to a known temperature scale, where the output voltage Vout varies in proportion to changes in temperature.

A pair of npn transistors Q1 and Q2 conduct different current densities to establish the basic PTAT voltage ΔVBE. In the exemplary embodiment illustrated in FIG. 2, the ratio of their current densities is preferably set by substantially equating the collector current IQ1 of transistor Q1 to the collector current IQ2 of transistor Q2, suitably 3–5 microamperes, and providing transistor Q2 with an emitter area Ae2 that is larger than the emitter area Ae1 of transistor Q1. For example, emitter area Ae2 of transistor Q2 can be in the range of six to twenty times larger than the emitter area Ae1 of transistor Q1. Although transistors Q1 and Q2 are defined as having one and twelve emitters respectively, it will be appreciated that any ratio of emitters can be used. Typically, increasing the number of emitters of transistor Q2 increases the accuracy of the basic PTAT voltage ΔVBE due to decreased noise.

The bases of transistors Q1 and Q2 are connected to a resistor R1 to set the output offset. Typically, the value of offset resistor R1 is determined such that output voltage Vout is zero volts at a desired offset temperature and is scaled proportional to the particular temperature range, such as Celsius. The emitter of transistor Q2 is connected to resistor R2 to establish the basic PTAT voltage ΔVBE across resistor R2. As shown in FIG. 2, in an exemplary embodiment of the present invention, resistor R2 is a trimmable resistor, the value of which can be selected to provide a desired temperature output slope, such as 5 mV/° C., for a particular temperature scale. Since the total emitter current of transistor Q2 is proportional to temperature T, a positive temperature coefficient voltage is generated across trimmable resistor R2. Current sources I21, I25 and I27 are connected between voltage supply VCC and the collectors of transistors Q1, Q2 and Q3, respectively, and these supply currents IPTAT to maintain the basic PTAT voltage ΔVBE.

In operation, temperature sensor 200 turns ON when the voltage across capacitor CAP ramps up to turn ON current source I23 which is coupled between voltage supply VCC and the collector of transistor Q1. Then, two gain stages G1, G2 servo to provide the desired output voltage Vout. In the first gain stage G1, current source I23 functions as a servo amplifier for transistor Q1. Current source I21 provides current IPTAT to transistor Q1. When any imbalance occurs between the collector current $I_{CQ1}$ of transistor Q1 and current IPTAT from current source I21 due to resistor R1 loading, then first gain stage G1 operates to servo the base of transistor Q1 to the desired voltage. In particular, current source I23 turns ON to supply current proportional to base-emitter voltage ("IPTVBE") to resistor R1 and to ensure that the proper current IPTAT flows through transistor Q1. As a result, transistor Q2 also receives a voltage bias on its base.

In the second gain stage G2, transistor Q3 and non-inverting amplifier A2 function as a servo amplifier for transistor Q2. Current source I25 provides current IPTAT to transistor Q2. Temperature sensor 200 is balanced when the collector current $I_{CQ2}$ of transistor Q2 equals current IPTAT coming from current source I25. Any imbalance between collector current $I_{CQ2}$ of transistor Q2 and current IPTAT from current source I25 acts to drive the voltage on the base of transistor Q3 of gain stage G2 in the correct direction so as to servo the emitter of transistor Q2 to the desired voltage.

When temperature sensor 200 is not balanced, then second gain stage G2 operates to provide balance. Specifically, as shown in FIG. 2, the currents at node A comprise the emitter current of transistor Q2 and the currents through resistors R1, R2 and R3. Resistor R2 sinks IPTVBE current from resistor R1 and IPTAT current from transistor Q2. However, given that the resistance of resistor R2 is a fixed value, resistor R2 can only sink a limited amount of current. Therefore, gain stage G2 operates to pull the excess current through resistor R3.

For example, when the current from transistor Q2 is greater than current IPTAT, current from current source I25 is smaller than the current from transistor Q2. Without gain stage G2, more current would be supplied to resistor R2 than resistor R2 could sink. However, instead the voltage at the base of transistor Q3 decreases until the current through transistor Q3 decreases. Subsequently, inverting amplifier A2 gradually turns ON causing more current to be conducted through resistor R3. This causes output voltage Vout to rise. As output voltage Vout rises, current through resistor R3 increases. Therefore, the excess current supplied to node A by transistor Q2 is conducted through resistor R3. In this way, second gain stage G2 functions to ensure current IPTAT flows from transistor Q2.

In contrast, when the current from transistor Q2 is less than current IPTAT, current from current source I25 is larger than the current from transistor Q2. Without gain stage G2, resistor R2 would be sinking too little current. However, gain stage G2 functions to output more current from amplifier A2 which is supplied to resistor R2 through resistor R3. For example, the larger IPTAT current from current source I25 causes the voltage at the base of transistor Q3 to rise. When this voltage reaches approximately 0.65–0.7 Volts, the current through transistor Q3 begins to increase. Subsequently, non-inverting amplifier A2 gradually turns OFF causing output voltage Vout to fall. As output voltage Vout falls, current is supplied through resistor R3 to node A. In this way, temperature sensor 200 supplies current to transistor Q2 causing the collector current of transistor Q2 to increase.

Because of gain stage G1, the loop consisting of transistor Q1 and current source I23 has a large gain which can sometimes make temperature sensor 200 difficult to engineer with reliable dynamic stability. Thus, in an alternate embodiment, diode-coupled transistor Q15, shown with dashed lines in FIG. 2, is coupled between circuit ground and the bases of transistors Q1 and Q2. The addition of transistor Q15 reduces the gain of the loop including transistor Q1 and current source I23, making temperature sensor 200 easier to stabilize.

Figure 5:
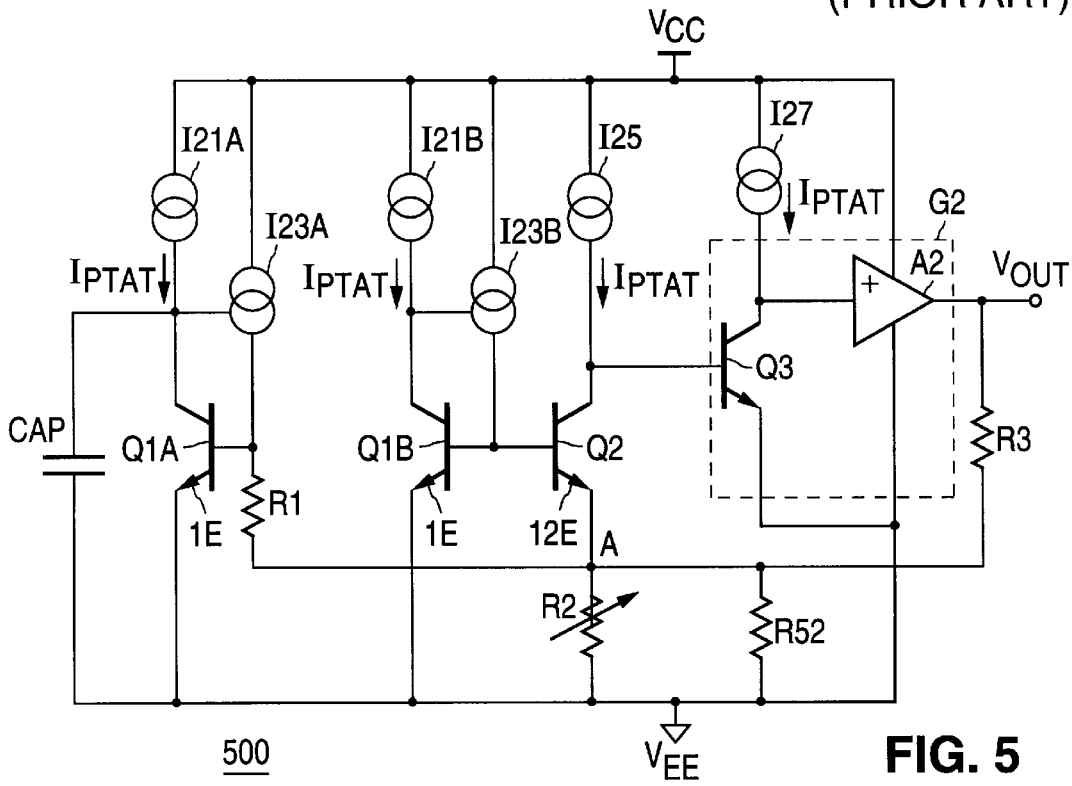
FIG. 5 is a schematic diagram of a temperature sensor in accordance with still another embodiment of the present invention.

An alternate embodiment of temperature sensor 200 is illustrated in FIG. 5. As shown in this figure, transistors Q1A, Q1B comprise transistor Q1 of temperature sensor 200 illustrated in FIG. 2. These transistors Q1A and Q1B are completely separate from each other. A current source I21A couples to transistor Q1A to provide current IPTAT to the transistor Q1A, while a current source I21B couples to transistor Q1B to provide current IPTAT to the transistor Q1B. Two current sources I23A, I23B couple to the base of transistors Q1A and Q1B respectively. Current source I23A functions as a servo amplifier for transistor Q1A and current source I23B functions as a servo amplifier for transistor Q1B. The operation of these current sources I23A, I23B is similar to that of current source I21 of temperature sensor 200 illustrated in FIG. 2. Thus, in temperature sensor 500 each transistor Q1A, Q1B has its own current source I21A, I21B and gain circuit I23A, I23B. Although resistor R1 is illustrated as coupled to transistor Q1A, in an alternate embodiment, resistor R1 couples to transistor Q1B.

Figure 3:
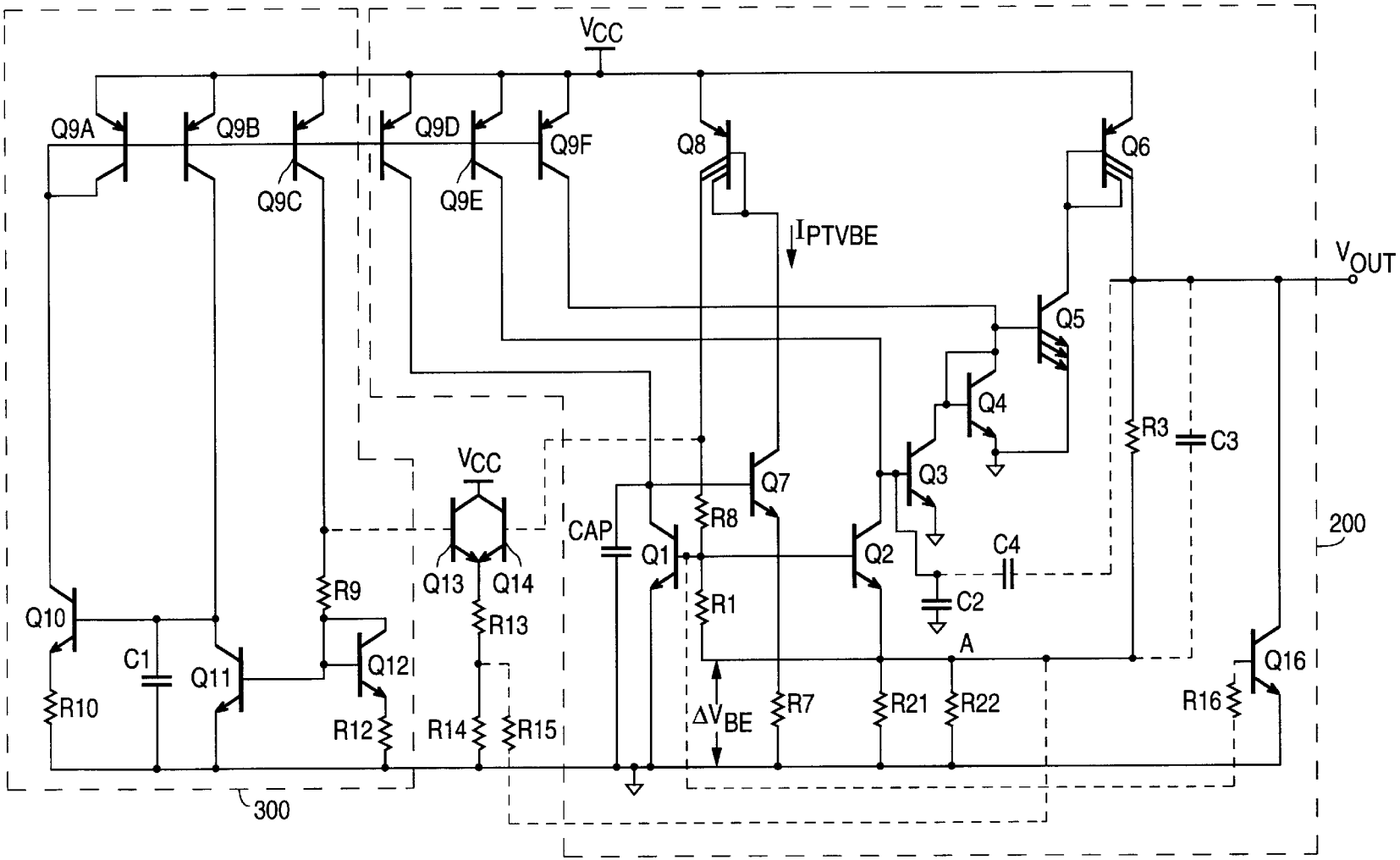
FIG. 3 is a schematic diagram of a bias circuit and a temperature sensor in accordance with another embodiment of the present invention.

A more detailed schematic diagram of temperature sensor 200 in accordance with the present invention is illustrated in FIG. 3 in conjunction with a bias circuit 300. Bias circuit 300 is illustrated for exemplary purposes only since this particular bias circuit operates at low voltage. It will be appreciated that many different types of bias circuits may be used with temperature sensor 200.

As shown in FIG. 3, transistors Q7 and Q8 comprise current source I23 of gain stage G1 illustrated in FIG. 2. In addition, transistors Q4–Q6 comprise non-inverting amplifier A2, and resistors R21, R22 comprise resistor R2 illustrated in FIG. 2.

Transistors Q9A–Q9F function as current sources. Transistors Q9A–Q9C and Q10–Q12 set up the current IPTAT bias source. Current sources Q9B–Q9F operate at a portion of the current fed into transistor Q9A. In an exemplary embodiment, transistor Q9A sets up a five microampere current in each of transistors Q9B–Q9F at 25° C., for biasing. Typically, transistor Q9A is tied away from transistors Q9B–Q9F so as not to influence or otherwise impede the regulation of those transistors Q9B–Q9F. Transistors Q9B and Q9C have their collectors low and at approximately equal voltages, so that their currents will match well. Similarly, transistors Q9D and Q9E are also well matched.

Transistors Q11 and Q12 have low and approximately equal collector-emitter voltage VCE, so that these transistors Q11, Q12 match well. Transistor Q10 is a gain stage, so its collector-emitter voltage VCE does not have to match those of transistors Q11 and Q12. Resistor R10, which is shown in FIG. 3 coupled to the emitter of transistor Q10, is optional. For example, in one exemplary embodiment, resistor R10 is not included and capacitor C1 has a large capacitance, such as for example 50 picofarads. In an alternate exemplary embodiment resistor R10 is included to enable temperature sensor 200 to operate at low current and capacitor C1 has a small capacitance, such as 6 picofarads. This later configuration is preferable when it is desirable to operate temperature sensor 200 at low voltage and low current.

Transistor Q11 is a one emitter (1E) transistor and transistor Q12 is a twelve emitter (12E) transistor, both of which operate at the same IPTAT current from transistors Q9B and Q9C. Therefore, transistor Q12 has a lower emitter-base voltage VBE than that of transistor Q11. As described in equations 2 and 3 above, $\Delta VBE=(kT/q)^* \ln(J2/J1)$. This voltage difference ΔVBE is impressed on resistor R12 which sets the current through transistor Q12. If the current from transistor Q1 does not equal the current from transistor Q12, then the bias circuit 300 performs servo functions until the currents are equal. In particular, any imbalance between collector current $I_{CQ11}$ of transistor Q11 and collector current $I_{CQ9B}$ of transistor Q9B, acts to drive the voltage on compensation capacitor C1 to ramp up and drive transistor Q10. Transistor Q10 then drives transistor Q9A so that transistor Q9B current equals the collector current of transistor Q11. In this way, transistor Q10 acts as a servo amplifier to assist bias circuit 300 in setting up the current IPTAT bias source. The servo amplifier transistor Q10 is damped by capacitor C1 and resistor R10.

Referring now to temperature sensor 200, the sensor 200 is comprised of transistors Q1–Q8 and Q9D–Q9F. In one embodiment of the present invention, it is desirable to have the base-emitter voltage VBE of transistor Q1 approximately equal to base-emitter voltage VBE of transistor Q11. As a result, it is desirable to have the current from current source Q9B well-matched to the current from current source Q9D. To make sure that this occurs given resistor R1 loading, first gain stage G1 operates to servo the base of transistor Q1 to the desired voltage. In particular, transistors Q7 and Q8 turn ON to supply current IPTVBE to resistor R1 and to ensure that the proper current IPTAT flows through transistor Q1. To provide such equivalence, transistors Q7 and Q8 function as a servo amplifier for transistor Q1. As mentioned above, these two transistors Q7, Q8 comprise current source I23 of gain stage G1 as shown in FIG. 2. This servo amplifier is damped by capacitor CAP and resistor R7.

In operation, when temperature sensor 200 is OFF, the collector of transistor Q1 is at 0 (zero) volts. Then, once temperature sensor 200 is turned ON, bias current source Q9D feeds current IPTAT to charge capacitor CAP. Once the voltage across capacitor CAP ramps up to approximately 0.65–0.7 volts, transistor Q7 turns ON. Transistor Q7 then turns ON transistor Q8. Transistor Q8 turns ON transistors Q1 and Q2 and also provides current IPTVBE to resistor R1. In one embodiment, this current IPTVBE is in the range of 2, 3 or 4 microamperes which corresponds to hot temperature, room temperature, and cold temperature, respectively.

Transistor Q9E provides current IPTAT to transistor Q2 which has its base voltage set by the base-emitter VBE of transistor Q1. In one embodiment, as shown in FIG. 3, transistor Q1 is a one emitter transistor (1E) and transistor Q2 is a twelve emitter (12E) transistor having an emitter resistance R21 of approximately 24 kilohms. Therefore, transistor Q2 operates at the same current as transistor Q1, but at one-twelfth of the density of transistor Q1.

Temperature sensor is balanced when collector current $I_{CQ2}$ of transistor Q2 equals collector current $I_{CQ9E}$ of transistor Q9E, which is current IPTAT. Any imbalance between the two collector currents $I_{CQ2}$, $I_{CQ9E}$ acts to drive the voltage on compensation capacitor C2 so as to servo the emitter of transistor Q2 to the desired voltage. In this way, current is conducted through resistor R3 to ensure output voltage Vout is directly proportional to changes in temperature. In particular, compensation capacitor C2 is driven to turn ON transistors Q3–Q6 which function as a servo amplifier to ensure the correct current is supplied to node A.

For example, when current from transistor Q9E is smaller than current from transistor Q2 to prevent too much current from being supplied to node A, the voltage across compensation capacitor C2 ramps down to decrease the current in transistor Q3. When transistor Q3 turns OFF, transistor Q4 turns ON because transistor Q9F pulls its base up toward voltage supply VCC. Since transistors Q4 and Q5 comprise a current mirror amplifier circuit, when transistor Q9F provides current IPTAT to transistor Q4, the output current from transistor Q5 is a multiple (n) of current IPTAT. In one embodiment, the ratio (n) of transistor Q4 to transistor Q5 may be set at 2 or 3 or 4 to provide more gain and minor bandwidth loss. If the ratio (n) is too small, then the gain is also small. On the other hand if the ratio (n) is large, then the bandwidth and phase shift of gain stage G2 may be degraded, making it difficult to stabilize the servo loop. Therefore care should be taken in determining the ratio (n).

The current output from transistor Q5 is then mirrored by pnp transistor Q6 which further amplifies the current. In the exemplary embodiment illustrated in FIG. 3, amplifier transistor Q6 has three collectors which further increase the gain of gain stage G2 of temperature sensor 200. For example, in one embodiment, transistor Q6 provides a gain of a factor of 2 (two). Transistor Q6 then drives resistor R3 so that the current through transistor Q2 is current IPTAT. In particular, when transistor Q6 turns ON, the excess current that resistors R21, R22 do not sink is conducted through resistor R3 increasing the output voltage Vout. In this way, the collector current of transistor Q2 can be reduced so as to equal the collector current of transistor Q9E.

On the other hand, when current from transistor Q9E is larger than current from transistor Q2, to prevent too little current from being supplied to node A, the voltage across compensation capacitor C2 ramps up to turn ON transistor Q3. Transistor Q3 then slightly turns OFF transistors Q4, Q5 by pulling the bases of the transistors Q4, Q5 toward circuit ground. Transistor Q6 then slightly turns OFF causing output voltage Vout to decrease. Thus, more current flows through resistor R3 to circuit node A increasing the current through transistor Q2. In this way, the collector current of transistor Q2 can be increased so as to equal the collector current of transistor Q9E.

The basic PTAT voltage ΔVBE is established across resistors R21 and R22. In addition, since transistor Q2 is a twelve emitter transistor and transistor Q1 is a one emitter transistor, and the base-emitter voltage VBE of transistor Q2 is less than that of transistor Q1, resistors R1 and R3 must conduct more current to the emitter of transistor Q2 to raise its emitter voltage. Resistors R21, R22 are made small so that current is required from resistors R1, R3.

As indicated above, the basic PTAT voltage ΔVBE is given by:

$$\Delta VBE = VBEQ1 - VBEQ2 \tag{1}$$

$$\Delta V_{BE} = \left[\frac{kT}{q}\right] * \ln\left(\frac{J2}{J1}\right) \tag{2}$$

Thus, as temperature increases, the basic PTAT voltage ΔVBE increases. In addition, the current IPTVBE through resistor R1 is given by:

$$IPTVBE = \frac{V_{BEQ2}}{R1} \tag{3}$$

Thus, as temperature T increases, the base-emitter voltage VBEQ2 of transistor Q2 decreases, for example, at about 2 mV/° C., since the base emitter voltage VBE of a conducting transistor has a negative temperature coefficient. The current IPTVBE through resistor R1 also decreases. Furthermore, the current through resistors R21 and R22 is given by:

$$I_{(R21||R22)} = \frac{\Delta V_{BE}}{(R21 \,||\, R22)} \tag{4}$$

Thus, as the temperature increases, so does the current through resistors R21 and R22. Now, calculating the sum of the currents at node A is given by:

$$I_{(R21||R22)} \cong \left(\frac{Vout - \Delta V_{BE}}{R3}\right) + IPTAT + \frac{V_{BEQ2}}{R1} \tag{5}$$

Substituting equation (5) into equation (6):

$$\frac{Vout}{R3} = \Delta V_{BE} * \left(\frac{1}{R21 \,||\, R22} + \frac{1}{R3}\right) - IPTAT - \frac{V_{BEQ2}}{R1} \tag{6}$$

Therefore output voltage Vout is equal to:

$$Vout = \left[\frac{\Delta V_{BE}}{\left(\frac{R21 \,||\, R22 * R3}{R21 \,||\, R22 + R3}\right)} - \frac{V_{BEQ2}}{R1}\right] * R3 - IPTAT * R3 \tag{7}$$

Thus, as temperature increases, current IPTVBE through resistor R1 decreases, the basic PTAT voltage ΔVBE increases, and therefore output voltage Vout increases. In this way, output voltage Vout extrapolates to zero volts at any desired offset temperature and increases linearly with temperature along a slope determined by geometrical factors. For example, the desired offset may be −50° C., 0° C., +50° C., 0° F., +32° F., or anything in between.

The ratio of resistors R1, R3, R21 and R22 are selected to provide a desired temperature output slope for a particular temperature scale. For example, in one embodiment, the ratio of resistors R1, R3, R21 and R22 are computed to give 5 mV/° C. at the output voltage Vout terminal. In alternate embodiments, the ratio of the resistors may be computed to provide 4, 6 or 10 mV/° C. at the output voltage Vout terminal. However, considering the span from −75 to 125° C., which is 200° C., that is a one volt span, which transistor Q6 can handle as a rail-to-rail amplifier. A Celsius temperature scale is discussed for exemplary purposes only. The offset and gain of temperature sensor 200 can be adjusted to accommodate both Fahrenheit and Celsius temperature sensors with a wide range of operating temperatures and gains.

Even without resistor R1 output voltage Vout would have a positive temperature coefficient and would be a voltage VPTAT. However, with resistor R1, the slope of temperature sensor circuit 200 increases, reflecting an increase in sensitivity, and a zero output voltage Vout is set at a given temperature for a more useful temperature sensor than one which goes down to absolute zero temperature.

It also may be advantageous to have a series resistor-capacitor ("R-C") network, rather than just a loop compensation capacitor CAP. This may permit the size of loop compensation capacitor CAP to be smaller and also provide improved loop stability, for example, less ringing. Therefore, the capacitors shown in the figures, such as capacitor CAP in FIGS. 2 and 3, and capacitors C1 and C2 in FIG. 3, may advantageously be made as a series R-C network. It will be appreciated that it may be advantageous to use other capacitors or series R-C networks such as capacitors C3, C4, shown in FIG. 3. The optimum network may be engineered in different ways to provide specific advantages of smooth response, tolerance of capacitive load, or smallest die size, so there is no one particular set of capacitors that is best. For example, referring again to FIG. 3, in one embodiment of the present invention, capacitor C1 has a capacitance of approximately 10 picofarads (pf) and a series resistance of 10 kilohms (K), capacitor CAP has a capacitance of 10 pf and a series resistance of 10 K, capacitor C2 has a capacitance of 10 pf and a series resistance of 10 K, capacitor C3 has a capacitance of 2 pf and capacitor C4 has a capacitance of 10 pf and a series resistance of 10 K.

It will be appreciated that resistors R8 and R9 are optional and can be used to set up the voltage VPTAT across resistor R9 and voltage VPTVBE across resistor R8.

It will also be appreciated that transistor Q16 can be included in temperature sensor 200 as a pull down transistor. As shown in FIG. 3 with dashed lines, the collector of transistor Q16 couples to output voltage Vout terminal, the emitter couples to circuit ground, and the base of transistor Q16 couples to the bases of transistors Q1, Q2. In addition, an optional resistor R16 can be coupled to the base of transistor Q16 to prevent transistor Q16 from interfering with the operation of transistor Q1, in case output voltage Vout is grounded or in case transistor Q16 is allowed to saturate. With such a configuration, transistor Q16 can pull output voltage Vout very near to circuit ground as may be required, for example, at cold temperatures.

Figure 4:
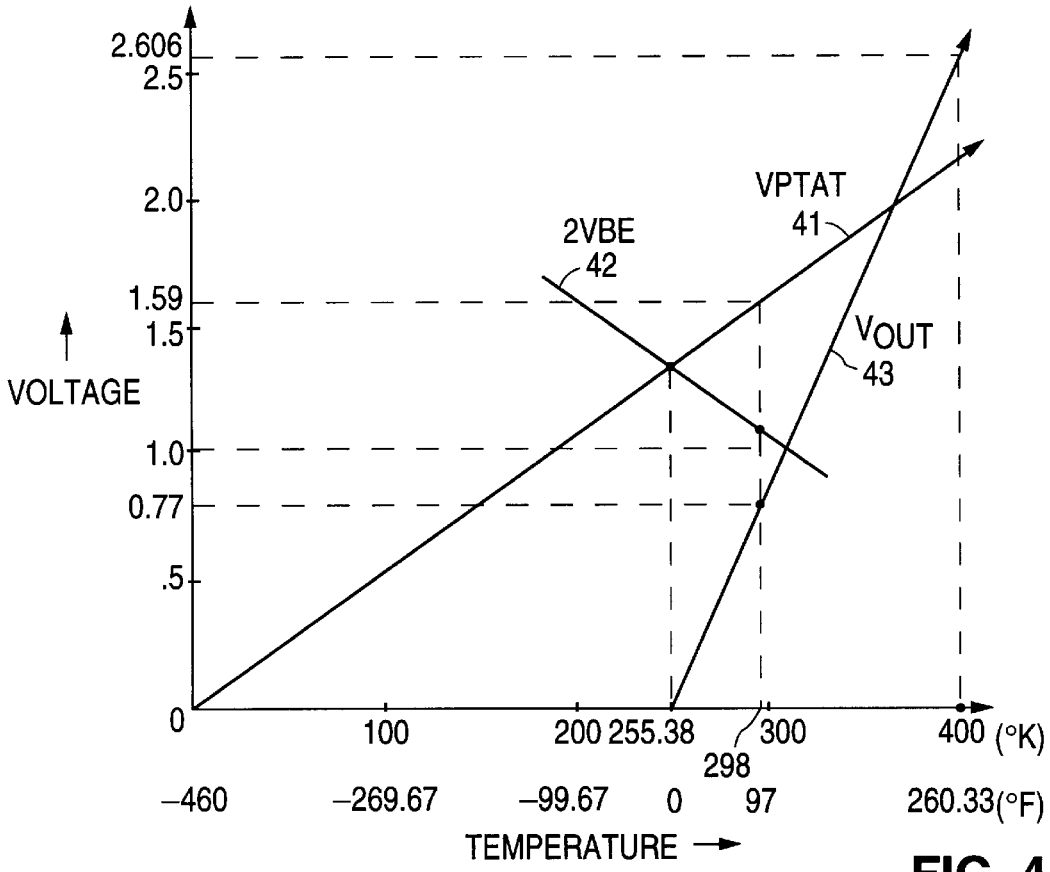
FIG. 4 (PRIOR ART)
FIG. 4 is a graph illustrating the temperature response of the conventional temperature sensor of FIG. 1.

In a further embodiment, an optional curvature correction circuit may be included to correct the deviation of the base-emitter voltages of transistors Q1, Q2 from a linear response to temperature. While FIG. 4 shows an idealized set of curves, in actual practice it has been found that the base-emitter voltage VBE plot 42 versus temperature is not a straight line but some curvature is present. If a precision wide range thermometer is desired, this curvature should be compensated.

As shown in FIG. 3, a curvature correction circuit comprises transistors Q13 and Q14 and resistors R13–R15. Current IPTAT is inherently linear, but base-emitter voltage VBE and current proportional to base-emitter voltage IPTVBE are not linear and may vary 1 or 2 percent over a wide temperature range such as −50 to +150° C. To compensate for this nonlinearity, in curvature correction circuit of FIG. 3, for example, at cold temperatures, transistor Q14 tends to conduct more than transistor Q13, raising the voltage across resistor R13 faster than the basic voltage VPTAT. At warm temperatures, transistor Q14 tends to conduct less than transistor Q13, and the basic voltage VPTAT is established across resistor R13. This nonlinear action may be used to couple a fraction of the emitter voltage of transistor Q14, into node A, by a suitable resistive connection. The ratio of resistor R13 and resistor R14 can be varied, and a resistance from the tap of resistors R13, R14 may be chosen for best results. Many circuits have been devised to correct linearity but these generally require more than one volt. The curvature correction circuit described herein is the type of circuit that can run on approximately one volt or less.

Referring again to FIG. 3, in an exemplary embodiment, transistors Q9B–Q9F each supply approximately 3 microamperes of current IPTAT, and resistor R12 is approximately 21.54 K. In this exemplary embodiment, bias circuit 300 is used with temperature sensor 500 illustrated in FIG. 5. Typically, the ratio of resistor R12 of bias circuit 300, to resistor R52 of temperature sensor 500 illustrated in FIG. 5, should be 1:1 and the resistors R12, R52 should be well matched. However, the particular value of the resistance is not critical. As a practical matter, if the resistance of resistors R12, R52 is too small, then power can be wasted. Increasing the resistance can help the power supply drain, at a risk of decreasing the accuracy. Referring now to FIG. 5, in such an embodiment, resistor R52 has a resistance of approximately 21.54 K. Although resistors R2 and R52 are illustrated as two independent resistors, these resistors R2, R52 may be merged for layout efficiency reasons and because the resistor R2/R52 network may need to be trimmed.

In addition, referring again to FIG. 5, the ratio of resistor R1 to resistor R2 to resistor R3 is approximately 14.666R:R:13.092R, respectively, where R is the resistance of R2. In the particular exemplary embodiment, resistor R2 has the same resistance 21.54 K as resistors R12 and R52. However, it is not necessary that resistor R2 equal resistor R52, but the two resistors R2, R52 should be proportional. Since in this exemplary embodiment, resistor R2 has a resistance of 21.54 K, resistor R1 has a resistance of approximately 315.9 K, and resistor R3 has a resistance of approximately 282 K. These resistances may be fairly large and may use too much area in a layout. Therefore, these resistors R1, R2 and R3 can be scaled to lower values to fit in the layout. As a result, in this exemplary embodiment, temperature sensor 500 provides a 5 mV/° C. voltage response above −50° C., and operates over the range of −40° C. to 150° C. In addition, temperature sensor 500 operates on a 1.2 volt supply and provides a useful 0.0 to 1.0 volt output voltage Vout. For example, output voltage Vout is approximately 875 mV at 125° C. and approximately 750 mV at 100° C. In addition, in this exemplary embodiment temperature sensor 500 consumes very low power.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a temperature sensor, the temperature sensor comprising:

first and second Proportional To Absolute Temperature (PTAT) current sources that generate first and second PTAT currents a first resistive circuit coupled to a circuit node;

first and second transistors coupled to the first and second PTAT current sources respectively, the second transistor coupled to the first resistive circuit, and the first and second transistors configured to conduct first and second currents respectively with different current densities to establish a basic voltage PTAT across the first resistive circuit;

a second resistive circuit coupled to the first and second transistors and the circuit node;

a first gain circuit coupled between the first transistor and the second resistive circuit and configured to receive a difference between the first PTAT current and the first current through the first transistor and in accordance therewith generate a first servo current which is proportional to a voltage across the second resistive circuit; and a second gain circuit coupled to the second transistor and configured to receive a first signal responsive to a difference between the second current through the second transistor and the second PTAT current and in accordance therewith generate a second servo current, wherein the first and second servo currents drive the first and second transistors respectively such that the second gain circuit generates a temperature related output voltage which follows a predetermined temperature scale and has a substantially linear function with a desired offset temperature.

2. The apparatus of claim 1, wherein the temperature related output voltage extrapolates to zero volts at the desired offset temperature.

3. The apparatus of claim 1, wherein the first resistive circuit is trimmable to provide a desired temperature output slope for the predetermined temperature scale.

4. The apparatus of claim 1, further comprising an output resistive circuit coupled between an output of the second gain circuit and the circuit node and configured to conduct the second servo current, wherein the output resistive circuit is trimmable to provide a desired temperature output slope for the predetermined temperature scale.

5. The apparatus of claim 1, further comprising a curvature correction circuit coupled to the first gain circuit for correcting any deviation from a linear response to temperature.

6. The apparatus of claim 1, further comprising:

a supply voltage terminal coupled to the first and second PTAT current sources for receiving a supply voltage, wherein the supply voltage is less than 1.4 volts.

7. The apparatus of claim 1, further comprising a gain-limiting circuit coupled to the first and second transistors to limit gain from a loop comprising the first gain circuit and the first transistor.

8. The apparatus of claim 1, wherein the second gain circuit comprises an amplifier circuit.

9. The apparatus of claim 1, wherein the first transistor has an emitter coupled to a circuit ground.

10. The apparatus of claim 1, further comprising a pull down circuit coupled to an output of the second gain circuit and to the first and second transistors, and configured to cause the temperature related output voltage to be pulled down towards a circuit ground.

11. An apparatus including a temperature sensor, the temperature sensor comprising:

first and second Proportional To Absolute Temperature (PTAT) current sources that generate first and second PTAT currents respectively;

a first transistor having a first collector coupled to the first PTAT current source, a first base, and a first emitter coupled to a reference voltage supply;

a second transistor having a second collector coupled to the second PTAT current source, a second base coupled to the first base, and a second emitter coupled to a circuit node;

a first resistive circuit coupled to the circuit node and to the reference voltage supply, wherein the first and second transistors conduct respective first and second PTAT currents with different current densities which establishes a basic voltage PTAT across the first resistive circuit;

a second resistive circuit coupled to the first and second bases and to the circuit node and configured to shift the basic PTAT voltage by an offset voltage;

a first gain circuit coupled between the first collector and the second resistive circuit, and configured to receive a first signal responsive to a difference between a first collector current through the first transistor and the first PTAT current and in accordance therewith generate a first servo current which is proportional to a voltage across the second resistive circuit; and a second gain circuit coupled to the second collector and configured to receive a second signal responsive to a difference between a second collector current through the second transistor and the second PTAT current and in accordance therewith generate a second servo current, wherein the first and second servo currents drive the first and second transistors respectively such that the second gain circuit generates a temperature related output voltage shifted from the basic PTAT voltage by the offset voltage and following a predetermined temperature scale, wherein the temperature related output voltage corresponds to zero volts at a desired offset temperature.

12. The apparatus of claim 11, wherein the predetermined temperature scale is Celsius and the desired offset temperature is in the range of −50° C. to +50° C.

13. The apparatus of claim 11, wherein the predetermined temperature scale is Fahrenheit and the desired offset temperature is in the range of −52° F. to +32° F.

14. The apparatus of claim 11, wherein the first resistive circuit is trimmable and a ratio of the first resistive circuit to the second resistive circuit is selected to set the offset voltage.

15. The apparatus of claim 11, further comprising an output resistive circuit coupled between an output of the second gain circuit and the circuit node, wherein the output resistive circuit is trimmable to provide a desired temperature output slope for the predetermined temperature scale.

16. The apparatus of claim 11, further comprising an output resistive circuit coupled between an output of the second gain circuit and the circuit node and configured to conduct the second servo current, wherein the ratio of the first resistive circuit, the second resistive circuit and the output resistive circuit is selected to provide a desired temperature output slope for the predetermined temperature scale.

17. The apparatus of claim 16, wherein the desired temperature output slope is within the range of 2 to 20 mV/° C.

18. The apparatus of claim 11, further comprising a curvature correction circuit coupled to the first gain circuit for correcting any deviation from a linear response to temperature.

19. The apparatus of claim 11, further comprising:

a supply voltage terminal coupled to the first and second PTAT current sources for receiving a supply voltage, wherein the supply voltage is less than 1.4 volts.

20. The apparatus of claim 11, further comprising a gain-limiting circuit coupled to the first and second bases and to the circuit node and configured to limit gain from a loop comprising the first gain circuit and the first transistor.

21. The apparatus of claim 11, wherein the second gain circuit comprises an amplifier circuit.

22. The apparatus of claim 11, wherein the first emitter couples to a circuit ground.

23. The apparatus of claim 11, further comprising a pull down circuit coupled to an output of the second gain circuit and to the first and second bases, and configured to cause the temperature related output voltage to be pulled down towards a circuit ground.

24. The apparatus of claim 11, wherein the first resistive circuit comprises a plurality of resistive circuits.

25. An apparatus including a temperature sensor, the temperature sensor comprising:

first, second and third Proportional To Absolute Temperature (PTAT) current sources that generate first, second and third PTAT currents respectively;

a first transistor having a first collector coupled to the first PTAT current source, a first base, and a first emitter coupled to a reference voltage supply;

a second transistor having a second collector coupled to the second PTAT current source, a second base coupled to the first base, and a second emitter coupled to a circuit node;

a third transistor having a first collector coupled to the third PTAT current source, a third base, and a third emitter coupled to the reference voltage supply;

a first resistive circuit coupled to the circuit node and to the reference voltage supply, wherein the first and second transistors conduct respective first and second PTAT currents with different current densities which establishes a basic voltage PTAT across the first resistive circuit;

a second resistive circuit coupled to the third base and to the circuit node and configured to shift the basic PTAT voltage by an offset voltage;

a first gain circuit coupled between the first collector and the first base, and configured to receive a first signal responsive to a difference between a first collector current through the first transistor and the first PTAT current and in accordance therewith generate a first servo current;

a second gain circuit coupled to the second collector and configured to receive a second signal responsive to a difference between a second collector current through the second transistor and the second PTAT current and in accordance therewith generate a second servo current; and a third gain circuit coupled between the third collector and the second resistive circuit, and configured to receive a third signal responsive to a difference between a third collector current through the third transistor and the third PTAT current and in accordance therewith generate a third servo current which is proportional to a voltage across the second resistive circuit;

wherein the first, second and third servo currents drive the first, second and third transistors respectively such that the second gain circuit generates a temperature related output voltage shifted from the basic PTAT voltage by the offset voltage and following a predetermined temperature scale, wherein the temperature related output voltage corresponds to zero volts at a desired offset temperature.

* * * * *